US008895903B2

(12) United States Patent
de los Toyos López et al.

(10) Patent No.: US 8,895,903 B2
(45) Date of Patent: Nov. 25, 2014

(54) METHODS AND APPARATUS FOR CONTROLLING THE SUPPLY OF POWER TO A RADIANT HEATER OF A COOKING APPLIANCE

(75) Inventors: Daniel de los Toyos López, Eibar (ES); Jon Endika Azpiritxaga Zalbide, Durango (ES); Agustin Etxebarrieta Alonso, Forua (ES)

(73) Assignee: Eika, S. Coop, Etxebarria (ES)

( * ) Notice: Subject to any disclaimer, the term of this patent is extended or adjusted under 35 U.S.C. 154(b) by 796 days.

(21) Appl. No.: 13/158,239

(22) Filed: Jun. 10, 2011

(65) Prior Publication Data

US 2012/0099845 A1 Apr. 26, 2012

(30) Foreign Application Priority Data

Oct. 20, 2010 (ES) ..... 201031544

(51) Int. Cl.
*H05B 1/02* (2006.01)
*F24C 15/10* (2006.01)

(52) U.S. Cl.
CPC ..... *F24C 15/106* (2013.01); *H05B 1/0266* (2013.01)
USPC ..... 219/481; 219/446.1; 219/448.11; 219/413; 219/509; 219/508

(58) Field of Classification Search
CPC .. H05B 1/0266; H05B 1/0202; H05B 1/0263; H05B 1/0258; F24C 15/106; F24C 7/046; F24C 7/083; F24C 7/082
USPC ..... 219/445.1, 446.1, 448.11, 448.17, 219/412–414, 483–486, 507–510, 497
See application file for complete search history.

(56) References Cited

U.S. PATENT DOCUMENTS

| | | | | |
|---|---|---|---|---|
| 4,110,600 | A * | 8/1978 | Spotts et al. | 392/368 |
| 4,740,664 | A * | 4/1988 | Payne et al. | 219/448.12 |
| 6,057,529 | A | 5/2000 | Kirby | |
| 7,268,324 | B2 * | 9/2007 | Liebold et al. | 219/506 |
| 8,097,834 | B2 * | 1/2012 | Scott et al. | 219/441 |
| 2004/0262289 | A1 * | 12/2004 | Sauter et al. | 219/483 |
| 2006/0027564 | A1 * | 2/2006 | Wilde et al. | 219/492 |

* cited by examiner

*Primary Examiner* — Mark Paschall
(74) *Attorney, Agent, or Firm* — Tim L. Kitchen; Peter B. Scull; Hamilton DeSanctis & Cha, LLP

(57) ABSTRACT

Methods and apparatus for controlling the supply of power to a radiant heater of a cooking hob. According to one implementation a method is provided that includes the use of a control circuit that is configured to deliver power to the radiant heater via first and second electrical paths. One control method includes supplying a first level of power to the radiant heater through a closed disconnection switch situated in the first electrical path while sensing a temperature of the cooking hob. Upon detecting that the temperature has reached or exceeded a predetermined temperature, the control circuit terminates the supply of power to the radiant heater through the first electrical path by opening the disconnection switch and for at least a period of time initiating the supply of a second level of power to the radiant heater through the second electrical path, the second level of power being less than the first level of power and sufficiently low to cause the radiant heater to cool.

21 Claims, 3 Drawing Sheets

METHODS AND APPARATUS FOR CONTROLLING THE SUPPLY OF POWER TO A RADIANT HEATER OF A COOKING APPLIANCE

CROSS-REFERENCE TO RELATED APPLICATIONS

The present application relates to and claims the benefit of Spanish Patent Application No. P201031544, filed Oct. 20, 2010.

TECHNICAL FIELD

The invention relates to methods and apparatus for supplying power to a radiant heater of a cooking appliance.

BACKGROUND

Radiant heaters adapted to glass-ceramic cooking hobs that comprise an insulating base on which is arranged at least one electrical resistor and a temperature-limiting device that includes a sensor that is arranged on the electrical resistor are known in the state of the art, the limiting device being switched on when the sensor detects inside the radiant heater a pre-set limit temperature, with the result that the radiant heater is switched off until the sensor of the temperature-limiting device detects inside the radiant heater a temperature lower than the reset temperature of the automatic switch, time after which the radiant heater is supplied once more in order to provide the required power.

One of the problems associated to this type of radiant heater is that when the temperature-limiting device switches on, the radiant heater switches off, giving the user the impression that it is defective, as it switches on and off cyclically, controlled by an ON/OFF switch for the obtaining of the required power, and also creating the false impression that the radiant heater is cold. To solve the latter problem some radiant heaters, such as the one described in U.S. Pat. No. 7,268,324 B2, include electronic monitoring means that includes a switch adapted to switch on a lighting device. The lighting device remains switched on for a period of time after the radiant heater has been disconnected, with the result that the temperature of the glass-ceramic hob falls to a temperature at which the user may touch it without any danger of being burned.

In U.S. Pat. No. 6,057,529 the radiant heater comprises a temperature-limiting device that includes an expanding rod or pipe that acts as a sensor member, and a switch device that includes five terminals in contact with the expanding rod or pipe. Initially, the rod connects the first and second terminal, and the third and fourth terminals to each other respectively, with the result that when the radiant heater is connected a lighting device lights up to indicate that the radiant heater is on. When the temperature-limiting device switches on, the rod expands and disconnects the third and fourth terminals from each other, connecting the fourth and fifth terminal to each other. The connection between the fourth and fifth terminal is maintained during the connection/disconnection cycles of the temperature-limiting device, it being disconnected when the rod contracts after the measured temperature has dropped to a temperature that does not represent a danger to the user.

SUMMARY OF THE DISCLOSURE

According to one implementation a cooking appliance is provided that comprises a cooking hob, at least one radiant heater arranged beneath the cooking hob, which comprises at least one resistor adapted in order to release, during the operating of the radiant heater, a power set point of a certain value, the radiant heater being capable of being disconnected, during the operating, for at least one time of disconnection. The cooking appliance may comprise safety means arranged connected to the resistor, adapted to keep the resistor electrically supplied for at least one part of the time of disconnection, the power released by the resistor being in the case lower than the set power set point. During operation, therefore, the radiant heater releases a set power set point, while for at least one part of the time of disconnection that occurs during the operating, the resistor is supplied by means of the safety means, releasing a power level lower than that of the set value. As a result, the radiant heater reduces its level of luminosity but does not switch off completely, indicating to the user that the radiant heater is hot and also that, when the radiant heater emits light continuously, the user is not given the impression that the radiant heater is operating defectively. In addition, greater temperature uniformity is allowed in the radiant heater. Finally, the heater may also be built into intelligent network systems, as it allows suppliers to choose certain times to supply power levels lower than nominal levels.

According to one implementation a method for controlling the supply of power to a radiant heater of a cooking hob by use of a control circuit is provided, the control circuit configured to deliver power to the radiant heater via first and second electrical paths, the method comprising: supplying a first level of power to the radiant heater through a closed disconnection switch situated in the first electrical path; sensing a temperature of the cooking hob; upon detecting that the temperature has reached or exceeded a predetermined temperature, terminating the supply of power to the radiant heater through the first electrical path by opening the disconnection switch and for at least a period of time initiating the supply of a second level of power to the radiant heater through the second electrical path, the second level of power being less than the first level of power and sufficiently low to cause the radiant heater to cool.

According to another implementation a method for controlling the supply of power to a radiant heater of a cooking hob by use of a control circuit is provided, the control circuit configured to deliver power to the radiant heater via first and second electrical paths, the method comprising: supplying a first level of power to the radiant heater in accordance with an on/off cycle through a closed disconnection switch situated in the first electrical path, the on/off cycle controlled by the closing and opening of a cycle switch, a second level of power being supplied to the radiant heater through the second electrical path during at least a period of time that the cycle switch is open, the second level of power being less than the first level of power; sensing a temperature of the cooking hob; upon detecting that the temperature has reached or exceeded a predetermined temperature, terminating the supply of power to the radiant heater through the first electrical path by opening the disconnection switch and for at least a period of time initiating the supply of the second level of power to the radiant heater through the second electrical path, the second level of power being sufficiently low to cause the radiant heater to cool.

According to one implementation a cooking appliance is provided that comprises: a cooking hob having a radiant heater; a control circuit arranged to supply at least a first level of power and a second level of power to the radiant heater, the second level of power being less than the first level of power, the control circuit comprising: a cycle switch adapted to open and close to supply the first level of power to the radiant heater in accordance with an on/off cycle; a temperature sensor adapted to sense the temperature of at least a portion of the cooking hob; a disconnection switch situated between the cycle switch and the radiant heater, the disconnection switch controlled to open and close according to the temperature detected by the temperature sensor, the disconnection switch controlled to assume an open position to prevent the supply of the first level of power to the radiant heater upon the temperature sensor detecting the temperature of the cooking hob to be at or exceeding a first predetermined temperature and controlled to assume a closed position upon the temperature sensor detecting the temperature of the cooking hob to be at or below a second predetermined temperature, the first predetermined temperature being greater than the second predetermined temperature; and a circuit device arranged in the control circuit to deliver the second level of power to the radiant heater when the disconnection switch is in the open position.

These and other advantages and characteristics of the invention will be made evident in the light of the drawings and the detailed description thereof.

DETAILED DISCLOSURE

Figure 1:
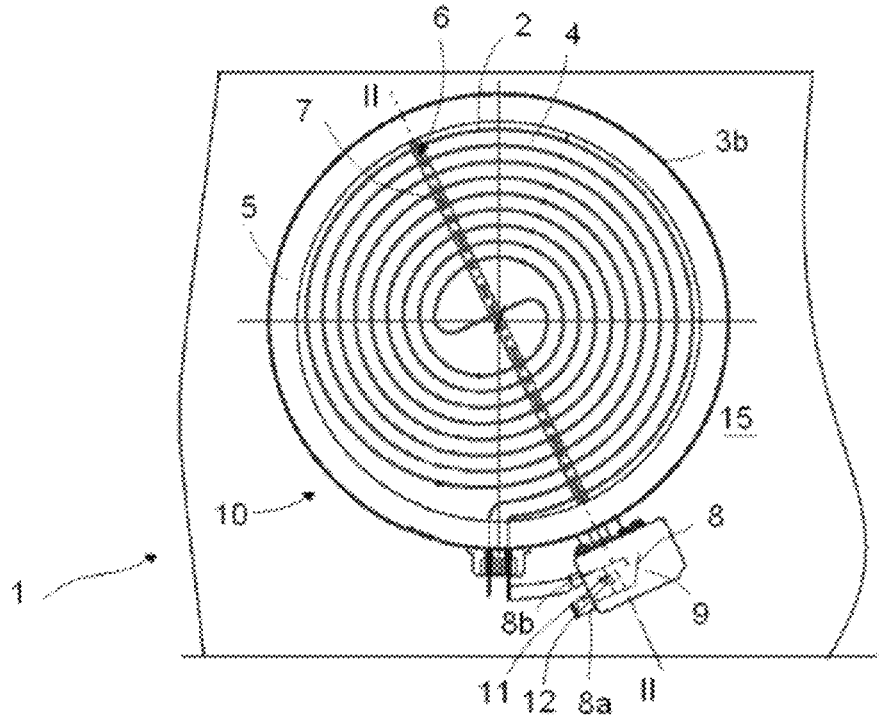
FIG. 1 shows a top view of a cooking appliance according to one implementation.
Figure 2:
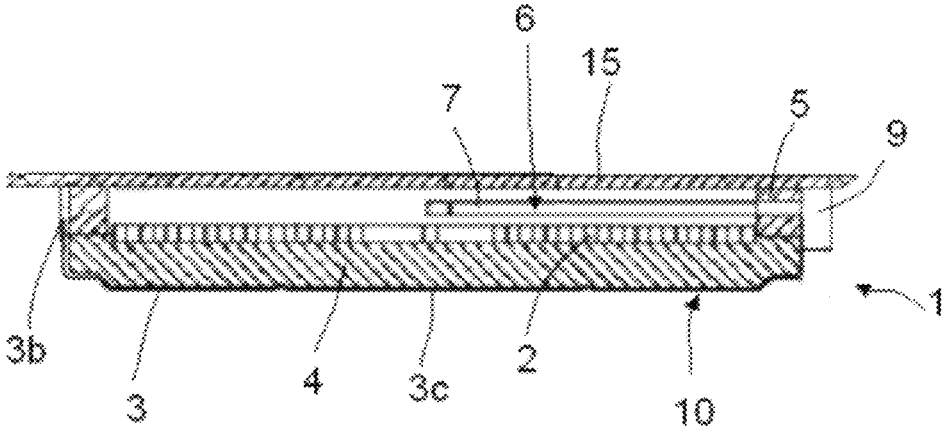
FIG. 2 shows a cross-section of the cooking appliance of FIG. 1 along the II-II line.

FIGS. 1 and 2 illustrate a cooking appliance 1 according to one implementation. In the example shown the cooking appliance comprises a cooking hob 15, in particular a glass-ceramic one, at least one radiant heater 10, arranged beneath the cooking hob 15, and a control device 18. The radiant heater 10, shown in detail in FIG. 2, comprises a metal cover 3 with the shape of a circular recipient with a substantially vertical wall 3*b* of a certain height, a substantially cylindrical insulating base 4 made of a thermal and electrical insulating material arranged housed inside the cover 3, supported on a bottom 3*c* of the cover 3, and a resistor 2 inserted in the insulating base 4.

The radiant heater 10 also comprises an insulating ring 5, substantially supported on the insulating base 4 and which comes into contact with the inner surface of the cooking hob 15, and a temperature-limiting device 6 connected to the resistor 2 and the control device 18 of the cooking appliance 1. In other implementations not shown in the figures, the insulating ring 5 and the insulating base 4 may form a single piece.

In one implementation the temperature-limiting device 6 comprises a sensor member 7, for example, of the expanding rod or pipe type, which passes through the insulating ring 5 and extends diametrically on the entire insulating base 4 above the resistor 2, an insulating support 9 that is fixed to the exterior of the wall 3*b* of the cover 3 by known fixing means, and disconnection means or switch 8 arranged housed inside the support 9 and connected to the sensor member 7. The sensor member 7 is arranged between the resistor 2 and the cooking hob 15, it being capable of being in contact with the cooking hob 15. The disconnection means 8 comprises an automatic switch, shown schematically in FIG. 1, which includes respective terminals 8*a*,8*b* arranged inside the support 9, projecting out externally in relation to the support 9.

In one implementation each radiant heater 10 has a set maximum temperature that it cannot exceed during its operating so as to prevent potential damage to the cooking hob 15 and also to extend its useful life, the objective of the temperature-limiting device 6 being to limit the maximum temperature a limit that may be reached by the radiant heater 10 when it has been operating for a period of time. In addition, the temperature-limiting device 6 has set a reset temperature, the reset temperature being a pre-set temperature that enables the disconnection means 8 to be reset, from which point the temperature-limiting device 6 switches off.

The cooking appliance 1 comprises data entry means 17, which supply the control device 18 and by means of which the user switches the radiant heater 10 on or off and enters a power level corresponding to a set power set point at which the radiant heater 10 must operate. The control device 18 controls the power that the resistor 2 must release to operate at the power set point pre-set by the user, in accordance with a pre-set ON/OFF function for each power level selected.

The radiant heater 10 is disconnected, during its operating at the power set point, for at least one disconnecting time. The radiant heater 10 is disconnected when the temperature-limiting device 6 switches on when the radiant heater 10 reaches the limit temperature, the disconnecting time being in the case the time from which the temperature-limiting device 6 switches on when the limit temperature is detected until it switches off when the temperature in the radiant heater 10 falls to at least the reset temperature. Furthermore, the radiant heater 10 is also disconnected cyclically when a switch 19 is disconnected, for the OFF cycles, by the control device 18, the time of disconnection of the radiant heater 10 being in this case the disconnecting time of the cycle. The cycle switch 19 is arranged connected to the control device 18 and the temperature-limiting device 6, controlled by the control device 18.

In addition, the cooking appliance 1 comprises safety means 11 arranged connected to the resistor 2, adapted to keep the resistor 2 electrically supplied for at least one part of the time of disconnection of the radiant heater 10, the power released by the resistor 2 being in the case lower than the power set point corresponding to the established power level.

Figure 3:
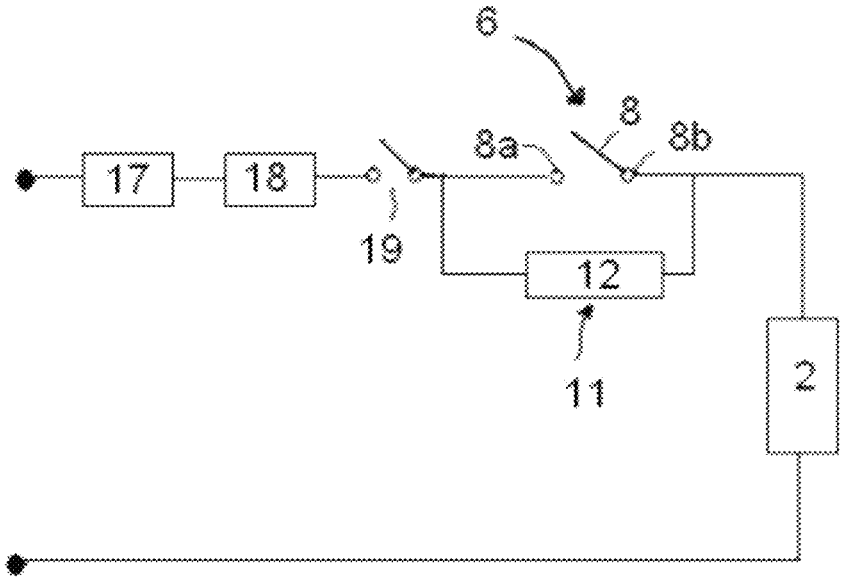
FIG. 3 illustrates a control circuit according to one implementation.

FIG. 3 schematically shows the electrical connections of the cooking appliance 1 according to one implementation. The safety means 11 comprise a power diode 12 that is arranged connected to the cycle switch 19, in parallel to the temperature-limiting device 6, in particular the power diode 12 is arranged connected to the respective terminals 8*a*,8*b* of the disconnection means 8 of the temperature-limiting device 6. The power diode 12 may be arranged built into in the temperature-limiting device 6, connected to the disconnection means 8, as shown in FIG. 1. As a result, a safe and compact radiant heater 10 is obtained, as the safety means are built into the radiant heater 10 itself.

In general terms, initially the user activates the data entry means 17, switching on the corresponding radiant heater 10 and indicating the power level corresponding to the power set point at which the radiant heater 10 must operate or release, with the result that the control device 18 of the radiant heater 10 adapts the supply of the resistor 2, in accordance with the pre-set ON/OFF cycle, in order to reach the power set point. Following an operating time, the heat generated by the resistor 2 increases the temperature inside the radiant heater 10, the temperature-limiting device 6 being switched on in the event that the sensor member 7 has detected the pre-set maximum temperature. At this point, the radiant heater 10 does not switch off completely but reduces the level of luminosity, as the safety means 11 starts operating. The power released by the resistor 2 when the temperature-limiting device 6 is switched off generates inside the radiant heater 10 a temperature lower than the reset temperature of the temperature-limiting device 6, enabling the radiant heater 10 to cool from the limit temperature to the reset temperature at least.

In one implementation the safety means 11 is adapted so that the resistor 2 releases, for the disconnecting time of the temperature-limiting device 6, a power level of approximately 50% of the established power set point. Once the sensor member 7 detects the reset temperature, the connection means 8 resets (the disconnection switch closes), the resistor 2 being supplied with the necessary energy to reach the power set point corresponding to the level of power initially set by the user.

Figure 4:
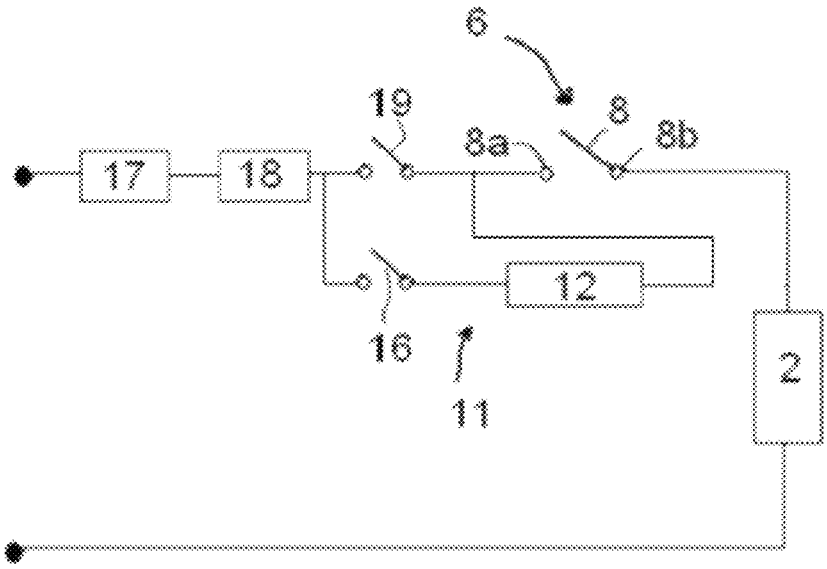
FIG. 4 illustrates a control circuit according to another implementation.

In addition, FIG. 4 shows a diagram of the electrical connections of another implementation in which the safety means 11 is arranged connected directly to the control device 18, regardless of the switch 19, as a result of which the safety means 11 operate for at least one part of the time of disconnection of the ON/OFF cycles of the radiant heater 10. During this time of disconnection, the control device 18 switches on the safety means 11 with the result that the resistor 2 does not switch off for the disconnecting times of the ON/OFF cycles but reduces its luminosity, releasing a residual power that corresponds approximately to 50% of the power set point corresponding to the level of the established power set point. In this implementation the safety means 11 is not switched on when the temperature-limiting device 6 switches on.

According to one implementation the power diode 12 is located outside the temperature-limiting device 6, and may, for example, be located in the control panel of the cooking appliance.

Figure 5:
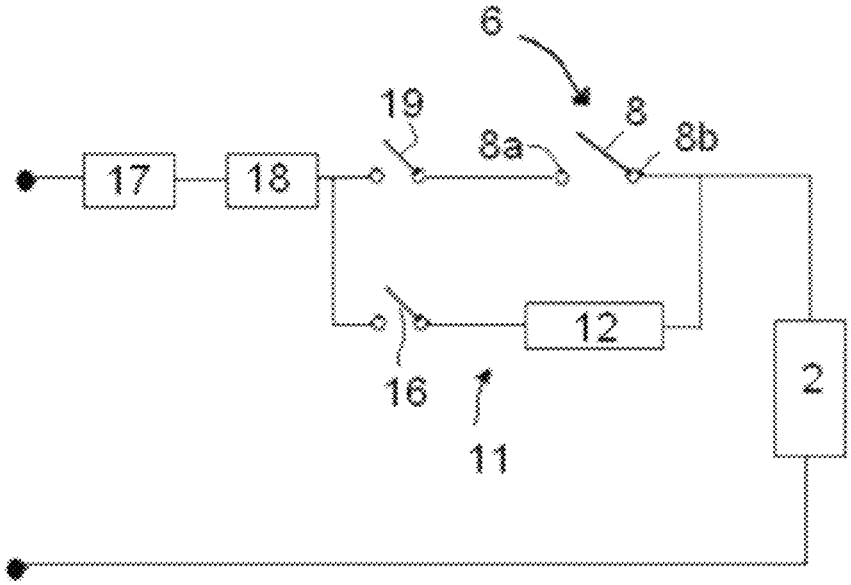
FIG. 5 illustrates a control circuit according to yet another implementation.

FIG. 5 shows a diagram of the electrical connections of another implementation in which the safety means 11 is arranged connected directly to the control device 18, in parallel with the switch 19 and with the temperature-limiting device 6, as a result of which not only do the safety means 11 operate for at least one part of the time of disconnection of the ON/OFF cycles of the radiant heater 10 but also for the time of disconnections of the temperature-limiting device 6. During both times of disconnections the control device 18 switches on the safety means 11 with the result that the resistor 2 does not switch off for the time of disconnections but reduces its luminosity, releasing a residual power that corresponds approximately to 50% of the power set point corresponding to the power level entered.

According to one implementation the power diode 12 is located outside the temperature-limiting device 6, and may, for example, be located in the control panel of the cooking appliance.

In the implementations illustrated in FIGS. 4 and 5, the safety means 11 comprise a safety switch 16, as shown in FIGS. 4 and 5, which enables the switching on of the safety means 11 for the entire time of disconnection of the ON/OFF cycle or for part of the time of disconnection, bearing in mind that the resistor 2 has to release the power set point corresponding to the pre-set value and that the time during which the radiant heater 10 is kept lit should be the maximum possible. Subsequently, once the time of disconnection has ended, the control device 18 connects the switch 19 at the same time as it disconnects the safety switch 16, in the event that the safety switch 16 has been switched off before the time of disconnection ends, the entire power set point in the resistor 2 being released.

In the implementation of FIG. 5, following an operating time, in which the heat generated by the resistor 2 raises the temperature inside the radiant heater 10 to the limit temperature, the temperature-limiting device 6 switches on. At this point, the radiant heater 10 does not switch off completely but reduces its level of luminosity, as the safety means 11 start operating, the radiant heater 10 releasing the residual power, enabling the radiant heater 10 to cool from the disconnection limit temperature to at least the reset temperature. When the sensor member 7 detects the reset temperature, the connection means 8 reset, the resistor 2 being supplied with the necessary energy to reach the power set point level initially set by the user. In particular, when the user sets as a power level corresponding to the nominal or maximum power of the radiant heater 10, the control device 18 switches the safety switch 16 on permanently.

In other implementations not shown in the figures, the radiant heater may also comprise an auxiliary resistor that enables rapid heating, and an auxiliary temperature-limiting device connected to the auxiliary resistor, the safety means arranged fixed to the main temperature-limiting device.

Implementations further relate to any one or more of the following paragraphs:

1. Cooking appliance that comprises a cooking hob (15), at least one radiant heater (10), arranged beneath the cooking hob, which comprises at least one resistor (2) adapted to release, during the operating of the radiant heater, a power level of a certain value, the radiant heater being capable of being disconnected during the operating for at least one time of disconnection, and cooking appliance further comprising safety means (11) arranged connected to the resistor (2), adapted to keep the resistor (2) electrically supplied for at least one part of the disconnecting time, the power released by the resistor (2) in the case being lower than the set power set point.

2. Cooking appliance according to paragraph 1, wherein the radiant heater (10) comprises a temperature-limiting device (6) connected to the resistor (2) and adapted to disconnect the radiant heater (10), the time of disconnection being the time from which the temperature-limiting device (6) detects a limit temperature in the radiant heater (10) until the temperature in the radiant heater (10) reduces at least until a reset temperature of the temperature-limiting device (6).

3. Cooking appliance according to paragraph 2, wherein the safety means (11) are adapted to release in the resistor (2), during the time of disconnection, a power level that enables the temperature-limiting device (6) to be reset.

4. Cooking appliance according to either of paragraphs 2 or 3, wherein the safety means (11) are adapted so that the resistor (2) releases, during the time of disconnection, a power level of approximately 50% of the established power set point.

5. Cooking appliance according to any of paragraphs 2 to 4, wherein the temperature-limiting device (6) comprises a support (9) that is arranged fixed on the exterior of a cover (3) of the radiant heater (10), a sensor member (7) that is arranged on the resistor (2) and disconnection means (8) arranged connected to the resistor (2) and housed in the support (9), the safety means (11) being arranged connected to the disconnection means (8) and built into the temperature-limiting device (6).

6. Cooking appliance according to any of paragraphs 1 through 5, wherein the safety means (11) comprise a power diode (12).

7. Cooking appliance according to any of paragraphs 1 through 6, wherein it comprises a control device (18) adapted to release the power set point in the resistor (2) in accordance with an ON/OFF cycle, the time of disconnection of the radiant heater (10) during its operating, being the time of disconnection of the cycle.

8. Cooking appliance according to paragraph 7, wherein the radiant heater (10) is arranged connected to the control device (18) by a switch (19), the safety means (11) being arranged connected to the switch (19).

9. Cooking appliance according to paragraph 7, wherein the radiant heater (10) is arranged connected to the control device (18) by means of a switch (19), the safety means (11) being arranged connected to the control device (18), separate to the switch (19).

10. Cooking appliance according to paragraph 9, wherein the safety means (11) are arranged connected in parallel to the switch (19) and to the temperature-limiting device (6).

11. Cooking appliance according to either of paragraphs 9 or 10, wherein the safety means (11) comprise a safety switch (16) adapted to keep the safety means (11) connected.

12. Operating method for a cooking appliance (1), which comprises at least one radiant heater (10), the radiant heater (10) comprising at least one resistor (2) and a temperature-limiting device adapted to disconnect the radiant heater (10) when a limit temperature is reached in the radiant heater (10), during the operating of the radiant heater (10), the resistor (2) releases a power set point, and when, during the operating, the radiant heater (10) is disconnected during a time of disconnection, the resistor (2) is supplied for at least one part of the time of disconnection by means of safety means (11), the resistor (2) releasing in the case a power level lower than the established power set point.

13. Operating method according to paragraph 12, wherein the resistor (2) releases a power level of approximately 50% of the power set point of the radiant heater (10), for at least the part of the time of disconnection.

14. Operating method according to either of paragraphs 12 or 13, wherein the resistor (2) releases a power level lower than the power set point while the temperature-limiting device (6) is switched on, when the limit temperature is reached in the radiant heater (10).

15. Operating method according to any of paragraphs 12 to 14, wherein the resistor (2) releases a power level lower than the power set point, for at least part of the time of an ON/OFF cycle during which the radiant heater (10) is disconnected, the ON/OFF cycle being a control cycle by which a control device (18) comprised in the cooking appliance (1) controls the radiant heater (10).

What is claimed is:

1. A method for controlling the supply of power to a radiant heater of a cooking hob by use of a control circuit, the control circuit configured to deliver power to the radiant heater via first and second electrical paths, the method comprising:

supplying a first level of power to the radiant heater through a closed disconnection switch situated in the first electrical path;

sensing a temperature of the cooking hob;

upon detecting that the temperature has reached or exceeded a predetermined temperature, terminating the supply of power to the radiant heater through the first electrical path by opening the disconnection switch and for at least a period of time initiating the supply of a second level of power to the radiant heater through the second electrical path, the second level of power being less than the first level of power and sufficiently low to cause the radiant heater to cool.

2. A method according to claim 1, further comprising terminating the supply of the second level of power to the radiant heater through the second electrical path and initiating the supply of power to the radiant heater through the first electrical path by closing the disconnection switch upon detecting that the temperature has fallen to a predetermined temperature.

3. A method according to claim 1, wherein the first and second electrical paths are situated parallel to one another.

4. A method according to claim 3, wherein the second level of power is at least partially determined by a power diode situated in the second electrical path.

5. A method according to claim 1, wherein the radiant heater illuminates upon a threshold level of power being supplied to it, the second level of power supplied to the radiant heater through the second electrical path being sufficient to cause the radiant heater to illuminate.

6. A method according to claim 1, wherein the second power level is about fifty percent that of the first power level.

7. A method according to claim 1, wherein the first power level is supplied to the radiant heater in accordance with an on/off cycle that is controlled by a power cycle switch.

8. A method according to claim 3, wherein the first power level is supplied to the radiant heater in accordance with an on/off cycle that is controlled by a power cycle switch, the power diode being connected to the power cycle switch.

9. A method for controlling the supply of power to a radiant heater of a cooking hob by use of a control circuit, the control circuit configured to deliver power to the radiant heater via first and second electrical paths, the method comprising:

supplying a first level of power to the radiant heater in accordance with an on/off cycle through a closed disconnection switch situated in the first electrical path, the on/off cycle controlled by the closing and opening of a cycle switch, a second level of power being supplied to the radiant heater through the second electrical path during at least a period of time that the cycle switch is open, the second level of power being less than the first level of power;

sensing a temperature of the cooking hob;

upon detecting that the temperature has reached or exceeded a predetermined temperature, terminating the supply of power to the radiant heater through the first electrical path by opening the disconnection switch and for at least a period of time initiating the supply of the second level of power to the radiant heater through the second electrical path, the second level of power being sufficiently low to cause the radiant heater to cool.

10. A method according to claim 9, further comprising initiating the supply of power to the radiant heater through the first electrical path by closing the disconnection switch upon detecting that the temperature has fallen to a predetermined temperature.

11. A method according to claim 9, wherein the second level of power is at least partially determined by a power diode situated in the second electrical path.

12. A method according to claim 9, wherein the radiant heater illuminates upon a threshold level of power being supplied to it, the second level of power supplied to the radiant heater through the second electrical path being sufficient to cause the radiant heater to illuminate.

13. A method according to claim 9, wherein the second power level is about fifty percent that of the first power level.

14. A method according to claim 9, further comprising terminating the supply of power to the radiant heater through the second electrical flow path for at least a duration of time when the cycle switch is open.

15. A cooking appliance comprising:

a cooking hob having a radiant heater;

a control circuit arranged to supply at least a first level of power and a second level of power to the radiant heater, the second level of power being less than the first level of power, the control circuit comprising:

a cycle switch adapted to open and close to supply the first level of power to the radiant heater in accordance with an on/off cycle;

a temperature sensor adapted to sense the temperature of at least a portion of the cooking hob;

a disconnection switch situated between the cycle switch and the radiant heater, the disconnection switch controlled to open and close according to the temperature detected by the temperature sensor, the disconnection switch controlled to assume an open position to prevent the supply of the first level of power to the radiant heater upon the temperature sensor detecting the temperature of the cooking hob to be at or exceeding a first predetermined temperature and controlled to assume a closed position upon the temperature sensor detecting the temperature of the cooking hob to be at or below a second predetermined temperature, the first predetermined temperature being greater than the second predetermined temperature; and a circuit device arranged in the control circuit to deliver the second level of power to the radiant heater when the disconnection switch is in the open position.

16. A cooking appliance according to claim 15, wherein the radiant heater illuminates upon a threshold level of power being supplied to it, the circuit device configured to produce the second level of power so that the second level of power is at or above the threshold level of power.

17. A cooking appliance according to claim 15, wherein the circuit device is a power diode.

18. A cooking appliance according to claim 15, wherein the control circuit comprises a first electrical path and a second electrical path, the first electrical path comprising the cycle switch, disconnection switch and radiant heater arranged sequentially in series, the second electrical path comprising the cycle switch, circuit device and radiant heater arranged sequentially in series, the disconnection switch and circuit device arranged in the control circuit parallel to one another.

19. A cooking appliance according to claim 15, wherein the control circuit comprises a first electrical path and a second electrical path, the first electrical path comprising the cycle switch, disconnection switch and radiant heater arranged sequentially in series, the second electrical path comprising the circuit device and radiant heater arranged sequentially in series, the circuit device arranged parallel to the cycle switch and disconnection switch in the control circuit.

20. A cooking appliance according to claim 19, further comprising a switch situated in the second electrical path in series with and before the circuit device, the switch adapted to assume a normally closed position and controlled to assume an open position to prevent the delivery of power to the radiant heater through the second electrical path during at least a portion of time when the cycle switch is in the open position.

21. A cooking appliance according to claim 15, wherein the control circuit is configured to deliver power to the radiant heater at the second power level at about fifty percent that of the first power level.

* * * * *